United States Patent [19]

Goffe

[11] 4,012,250

[45] Mar. 15, 1977

[54] IMAGING SYSTEM

[75] Inventor: William L. Goffe, Webster, N.Y.

[73] Assignee: Xerox Corporation, Stamford, Conn.

[22] Filed: Jan. 2, 1970

[21] Appl. No.: 77

[52] U.S. Cl. ..... 96/1 PS; 8/2.5 R

[51] Int. Cl.[2] ..... G03G 13/22

[58] Field of Search ..... 96/1, 1.2, 1.5, 1.1, 96/1.8, 1.7, 1 PS; 8/2.5 R

[56] References Cited

UNITED STATES PATENTS

| | | | |
|---|---|---|---|
| 2,297,691 | 10/1942 | Carlson | 96/1 |
| 2,987,395 | 6/1961 | Jarvis | 96/1.7 |
| 3,384,565 | 5/1968 | Tulagin et al. | 96/1.2 X |
| 3,510,419 | 5/1970 | Carreira et al. | 96/1.3 X |
| 3,515,549 | 6/1970 | Bixby | 96/1.5 |
| 3,520,681 | 7/1970 | Goffe | 96/1 |
| 3,556,781 | 1/1971 | Levy et al. | 96/1 R |
| 3,656,990 | 4/1972 | Goffe | 96/1 R |

*Primary Examiner*—Charles E. Van Horn

[57] ABSTRACT

A migration imaged member comprising an image pattern of material comprising a dye or a dye receptive material is contacted with a dye transfer member or a dye respectively to form a dye image on the dye transfer member or the imaged member respectively.

12 Claims, 4 Drawing Figures

INVENTOR.
WILLIAM L. GOFFE

BY David C. Petre

ATTORNEY

IMAGING SYSTEM

BACKGROUND OF THE INVENTION

This invention relates in general to imaging, and more specifically to a migration image-dye transfer system employing migration imaged members with migration material comprising dyes or a dye receptive material.

Recently, a migration imaging system capable of producing high quality images of high density, continuous tone, and high resolution has been developed. Such migration imaging systems are disclosed in copending application Ser. Nos. 837,780, now U.S. Pat. No. 3,975,195, and Ser. No. 837,591, both filed June 30, 1969 which are hereby expressly incorporated herein by reference. In a typical embodiment of the new migration imaging system an imaging member comprising a substrate with a layer of softenable material and electrically photosensitive particles is imaged in the following manner: a latent image is formed on the member, for example, by electrically charging the member and exposing it to a pattern of activating electromagnetic radiation such as light. Where the photosensitive marking material is originally in the form of a migration layer spaced apart from the substrate, material from the migration layer migrates imagewise toward the substrate when the member is developed by softening the softenable layer.

One mode of development entails exposing the member to a solvent which dissolves only the softenable layer. The photosensitive marking material (typically particles) which have been exposed to radiation migrate through the softenable layer as it is softened and dissolved, leaving an image of migrated particles corresponding to the radiation pattern of an original on the substrate with the material of the softenable layer substantially completely washed away. The particle image may then be fixed to the substrate. For many preferred photosensitive particles, the image produced by the above process is a negative of a positive original, i.e., particles deposit in image configuration corresponding to the radiation exposed areas. However, positive to positive systems are also possible by varying imaging parameters. Those portions of the photosensitive material which do not migrate to the substrate are washed away by the solvent with the softenable layer. As disclosed therein, by other developing techniques, the softenable layer may at least partially remain behind on the supporting substrate with or without a relatively unmigrated pattern of marking material complementary to said migrated material.

In another imaging member embodiment migration material is dispersed throughout the softenable layer in a binder layer configuration.

"Softenable" as used herein is intended to mean any material which can be rendered more permeable to migration material migrating through its bulk. Conventionally, changing permeability is accomplished by dissolving, melting and softening as by contact with heat, vapors, partial solvents and combinations thereof.

"Fracturable" layer or material as used herein, means any layer or material which is capable of breaking up during development, thereby permitting portions of said layer to migrate toward the substrate in image configuration. The fracturable layer may be particulate, semi-continuous, or continuous in various embodiments of the migration imaging members.

"Contiguous," for the purpose of this invention, is defined as in Webster's New Collegiate Dictionary, Second Edition, 1960; "In actual contact; touching; also, near, though not in contact; adjoining."

In certain methods of forming the latent image, nonphotosensitive or inert, fracturable layers and particulate material may be used to form images, for example, wherein an electrostatic latent image is formed by a wide variety of methods including charging in image configuration through the use of a mask or stencil; first forming such a charge pattern on a separate photoconductive insulating layer according to conventional xerographic reproduction techniques and then transferring this charge pattern to the imaging member by bringing the two layers into very close proximity and utilizing breakdown techniques as described, for example, in Carlson U.S. Pat. No. 2,982,647 and Walkup U.S. Pat. Nos. 2,825,814 and 2,937,943. In addition, charge patterns conforming to selected, shaped, electrodes or combinations of electrodes may be formed by the "TESI" discharge technique as more fully described in Schwertz U.S. Pat. Nos. 3,023,731 and 2,919,967 or by techniques described in Walkup U.S. Pat. Nos. 3,001,848 and 3,001,849 as well as by electron beam recording techniques, for example, as described in Glenn U.S. Pat. No. 3,113,179.

The characteristics of the images produced are dependent on such process steps as charging, exposure and development, as well as the particular combination of process steps. High density, continuous tone and high resolution are some of the image characteristics possible. The image is generally characterized as a fixed or unfixed particulate image with or without a portion of the softenable layer and unmigrated portions of the layer left on the imaged member.

In this new migration imaging system, the advantageous migration image-dye transfer imaging system of this invention has been invented.

SUMMARY OF THE INVENTION

It is, therefore, an object of this invention to provide a novel and advantageous migration image-dye transfer imaging system.

It is a further object of this invention to provide a migration image-dye transfer imaging system capable of producing multiple copies.

The foregoing objects and others are accomplished in accordance with this invention by providing a migration imaged member comprising an image pattern of material comprising a dye or a dye receptive material which is contacted with a dye transfer member or a dye respectively to form a dye image on the dye transfer member or the imaged member respectively.

BRIEF DESCRIPTION OF DRAWINGS

For a better understanding of the invention, as well as other objects and further features thereof, reference is made to the following detailed disclosure of this invention taken in conjunction with the accompanying partially schematic drawings wherein.

DESCRIPTION OF THE PREFERRED EMBODIMENTS

Figure 1A:
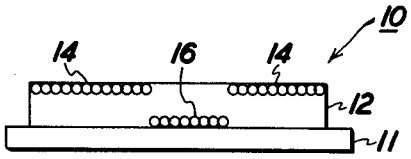
FIGS. 1A and 1B show two illustrations of two different embodiments of layered configuration migration imaged members.

Referring now to FIG. 1A there is shown a partially schematic drawing of an example of one embodiment of a migration imaged member 10 according to this invention comprising substrate 11 softenable layer 12 which contains contiguous its upper surface relatively unmigrated portions 14 of the migration layer and imagewise migrated portions 16 of the migration layer which have migrated through the bulk of layer 12 to substrate 11.

Figure 1B:
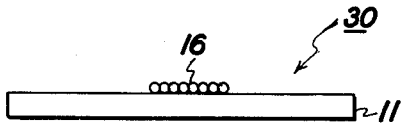

FIG. 1B is a partially schematic showing of a typical wash-away developed imaged migration imaged member with only the migrated particles 16 remaining on the substrate 11 with the bulk of the softenable layer 12 and the relatively unmigrated portions of the migration layer washed away during development.

A more detailed description of substrate 11, softenable layer 12, migration materials and migration imaging methods may be found in the two aforementioned copending applications.

While the members in FIG. 1 are illustrated to be layered configuration imaged members, binder migration imaging members as described in U.S. Pat. No. 837,591 may also be used.

Also, split migration imaged members produced as described in copending application Ser. No. 784,164 filed Dec. 16, 1968, now U.S. Pat. No. 3,741,757 may be used.

Figure 2:
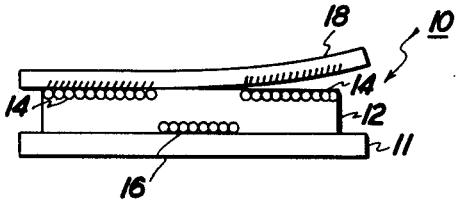
FIG. 2 shows an imaged member of the type of FIG. 1A wherein the particles comprise dye particles and the top surface of the imaged member is contacted with a dye transfer member.

Referring now to FIG. 2 there is shown an imaged member 10 with the migration material, typically both portions 14 and 16, but especially portions 14 comprising a dye and wherein member 18 is a piece of moistened dye transfer paper. Member 18 is pressed against the top surface of the imaged member for several seconds and then removed to produce a visible, typically brilliant dye image in the dye transfer paper, the dye transferring to and being imbibed into the paper from the adjacent relatively unmigrated areas 14.

Dye transfer member 18 may be any suitable transfer member capable of absorbing dye but preferably is generally composed of a hydrophillic layer or coating on the surface to be contacted with the migration imaged member, on a base. Typically the coating is a hydrophilic layer that swells and softens but does not dissolve upon moistening or soaking with a liquid typically water. Included in the class of water responsive members are cellulose and non-cellulose materials such as gelatin and hydrophilic or water swellable plastics.

Typical dye transfer layers contain a mordant. Also, natural or synthetic colloids may be used. This type of material is preferred because of the density and intensity of dye images attainable thereon as compared with other possible materials, such as ordinary paper. However ordinary paper may be used.

Any suitable dye transfer member may be used including such improved dye transfer layers as those described in Martin U.S. Pat. No. 3,060,052.

One commercial and preferred member 18 is Dye Transfer Paper Type F glossy from Kodak which generally comprises a sheet of white paper carrying the same layer of hardened gelatin emulsion containing a mordant as double weight glossy photographic paper, except that the silver salts are omitted.

Typically the transfer member 18 is prepared for the transfer step by immersion in water at room temperature for from 10 seconds to many minutes. When Kodak Dye Transfer Paper Type F is used it has been found that soaking in water for about 30 seconds gives optimum results. After the transfer member 18 is moistened excess water may be removed for example by blotting the layer or blotting it under pressure as by squeezing it through wringers to give it an impressionable and soft but not tacky surface. Where this preparation or activation of a transfer member is desired, it usually occurs before contacting with the imaged member but it may occur after transfer of the dye particles.

In the pressing of the prepared member 18 against the imaged member surface pressures of from about 5 to 10 pounds per linear inch in a pressure nip arrangement produce optimum results.

As disclosed in the two aforementioned copending applications many dyes have been found to work well in the migration imaging system disclosed therein in the preferred average particle size of from about 0.01 to about 2 microns to yield optimum resolution and highest density images. Of course, it is apparent that any dye that may be migration imaged may be used herein.

Preferably, the softenable layer is from about ½ to about 16 microns thick and optimally from about 1 to about 4 microns thick.

While the previous description has focused on the imaged member in FIG. 1 A the wash-away imaged member 30 shown in FIG. 1B may also be used with an opposite image sense being imparted to the dye transfer member since migrated portions 16 are doing the dyeing instead of the background portions 14 as described in relation to FIG. 1A. Also image portions 16 may be transferred, for example adhesively, to another substrate before being contacted to a dye transfer member.

Figure 3:
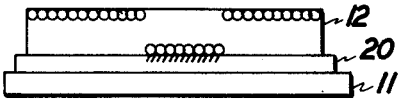
FIG. 3 is a partially schematic illustration of an imaged member of the type illustrated in FIG. 1A modified by having a dye transfer interlayer between the substrate and the softenable layer.

Referring now to FIG. 3 there is shown another embodiment of the invention wherein a dye transfer layer 20 is interposed between substrate 11 and softenable layer 12 and the dye is transferred from the migrated dye particles to the dye transfer layer.

In this FIG. 3 mode and also with respect to FIG. 1B where wash-away development is used, an advantageous migration image fixing method results in that the dye particles 16, which on an ordinary substrate typically may be rubbed off if they have not been fixed with an extra fixing step are caused to be imbibed into layer 20 or a separate dye transfer member 18, respectively, which upon drying provides for a fixed, usable image. If member 20 is of the type which is preferably moistened, moistioning may take place, for example, through a porous substrate 11. Paper and porous plastic films, for example polyvinylfluoride film available as Tedlar from Dupont, are typical porous substrates.

The FIG. 3 type dye image provides improved density images and greater color clarity over the migration image alone because of spreading of the dye particles.

The another embodiment of the invention an imaged member in either the FIG. 1A or FIG. 1B form wherein the migration material instead of comprising a dye comprises a dye receptive material such as gelatin particles may be dye colored by contacting the imaged member with a dye and removing any dye which has not been imbibed, leaving a dyed migration imaged member. Other dye receptive materials including those mentioned as dye receptive layers for member 18 may be used.

Any suitable mode of removing excess dye may be used including washing techniques and doctoring. Doctoring works best with the migration imaged member of FIG. 1A since the migration particles 14 are relatively fixed in softenable layer 12. Washing is especially suitable for the type of migration imaged members shown in FIG. 1B. Typically, the dye receptive particles are contacted with a dye solution or the particles moistened or otherwise made receptive when contacted to a dry dye.

Aqueous solutions of water-soluble dyes may be brought into contact with, for example, the gelatin image so as to allow the dye to be absorbed by the image. Excessive dye solution adhering to the gelatin matrix and any dye adhering to softenable layer portions may be removed by washing with an acidic cleaning water.

In both modes and especially in the mode where dye receptive migration material is used, the migration imaged member may be used as a master to produce multiple copies by transferring the dye by contact with a transfer receiver member, since the master may be replenished with dye after one or a certain number of transfer receiver member copies are made to produce an additional number of copies.

The following examples further specifically define the present invention with respect to this migration imaging-dye transfer system. The parts and percentages are by weight unless otherwise indicated. The examples below are intended to illustrate various preferred embodiments of the migration-dye transfer imaging system of this invention.

EXAMPLE I

An imaging member is prepared by first dissolving about 5 parts of Staybelite Ester 10, a partially hydrogenated rosin ester from Hercules Powder Co., in about 20 parts cyclohexanone and about 75 parts toluene. Using a gravure roller, the solution is then roll coated onto about a 3 mil Mylar polyester film having a thin semi-transparent aluminum overcoating. The coating is applied so that when air dried for about 2 hours to allow for evaporation of the cyclohexanone and toluene solvent, about a 2 micron layer of Staybelite Ester 10 is formed on the aluminized Mylar.

Submicron sized particles of Rhodamine B, a red watersoluble dye available from DuPont are cascaded (by cascading 50 micron glass beads, surface carrying the dye particles and heating the Staybelite slightly between groups of cascadings) over the about 2 micron layer of Staybelite Ester 10 to form about a 0.5 micron thick overlayer of migration material of Rhodamine B particles at least slightly embedded contiguous the upper surface of the Staybelite Ester 10.

The imaging member fabricated above is migration imaged by placing an image mask on top of the member and passing a corotron over the member to create on the member a positive electrostatic latent image with a surface potential of about 100 volts in electrostatic image areas. The member is developed by heating at about 70° C. for about 10 seconds to form an imaged member as shown in FIG. 1A with the migration material in charge areas migrating. Substrate 11 corresponds to the composite Mylar base and semi transparent aluminum layer spoken of in this Example, layer 12 corresponds to the Staybelite Ester 10 and portions 14 and 16 are composed of Rhodamine B.

A sheet of Paper Type F glossy Kodak dye transfer paper is moistened with water and then pressed against the surface of the migration imaged member in a roller press and removed. A visible bright red dye image in the dye transfer paper results corresponding to the relatively unmigrated portions of the migration layer of Rhodamine B dye particles said image being opposite in image sense and a mirror reverse of the original electrostatic latent image.

A second and third pressings of separate pieces of dye transfer paper were also made with similar results except that the subsequent transfer images showed slight loss of density.

EXAMPLE II

Example I is followed except the dye indigo carmine a water soluble dye, derived from treating indigotindisulfonic acid with soda, available from National Analine is used in place of the Rhodamine B.

EXAMPLE III

An imaging member as in Example I is latent imaged by electrically charging it with a corotron to a surface potential of minus about 100 volts and then exposing it to an image pattern of activating radiation, with an exposure of about 40 f.c.s. in illuminated areas.

The latent image is rendered visible by dipping the member in Sohio Odorless Solvent, a kerosene fraction available from Standard Oil Company of Ohio, to produce an image corresponding to the exposed areas of Rhodamine dye particles on the substrate similar to the imaged member in FIG. 1B.

Dye transfer paper is pressed against the imaged member as in Example I with the same results except that the dye image in the transfer paper corresponds to the migrated particles.

Although specific components and proportions have been stated in the above description of preferred embodiments of the migration image-dye transfer imaging system hereof other suitable materials as listed herein may be used with similar results with various degrees of quality. In addition, other materials which exist presently or may be discovered may be added to the materials used herein and variations may be made in the various processing steps to synergize, enhance, or otherwise modify the invention.

For example, full color images may be made from an adaption of the present invention by forming separate cyan, yellow and magenta dye migration imaged members. Each dye image is then separately transferred and registered to a single sheet of dye transfer paper.

Also of course while the migration layer is composed entirely of dye in the Examples, migration layers where only a portion of the layer is a dye may be used so long as sufficient dye is imbibed into the dye transfer layer according to this invention to produce a usuable image. Also, the migration layer may comprise mixtures of dyes.

One structure modification is that in FIG. 3 in some cases, substrate 11 may be eliminated and dye transfer layer may serve as the sole support for layer 12.

It will be understood that various other changes in the details, materials, steps and arrangements of parts, which have been herein described and illustrated in order to explain the nature of the invention will occur and may be made by those skilled in the art upon a reading of this disclosure and such changes are intended to be included within the principle and scope of this invention.

What is claimed is:

1. An imaging method comprising the steps of:

a. providing an imaging member comprising a substantially electrically insulating softenable layer containing migration material, said migration material comprising a dye, said softenable layer capable of having its resistance to migration of said migration material decreased sufficiently to allow migration of said migration material in depth in said softenable layer, said softenable layer overlying a dye transfer layer which is overlying a substrate, said dye transfer layer capable of being rendered more dye receptive than said substrate;

b. applying an electrical imagewise migration force to said migration material;

c. developing the softenable layer by decreasing the resistance of said softenable layer to migration of the migration material at least sufficient to allow an imagewise migration of migration material to said dye transfer layer; and d. rendering said transfer layer dye receptive whereby said dye material dyes said transfer layer.

2. An imaging method according to claim 1 wherein said migration material is particles with an average particle size between 0.01 to about 2 microns and said softenable layer is between about ½ to about 16 microns thick.

3. An imaging method according to claim 1 wherein the step of developing by decreasing resistance to migration is accomplished by contacting said softenable layer with a solvent therefor.

4. An imaging method comprising the steps of:

a. providing an imaged member comprising a layer of substantially electrically insulating softenable material and contiguous at least one surface of said softenable layer an image configuration of migration material comprising a dye receptive material, said softenable material capable of having its resistance to migration of said migration material decreased sufficiently to allow migration of said migration material in depth in said softenable material, by the method of applying an electrical imagewise migration force to migration material in a layer of substantially electrically insulating softenable material and developing said member by decreasing the resistance of said softenable material to migration of said migration material at least sufficient to allow said migration material to migrate through said softenable material in imagewise configuration;

b. contacting said image contiguous surface to a dye under dye receptive conditions for said migration material; and c. removing any excess dye to leave a dyed migration image of dyed dye receptive material.

5. An imaging method according to claim 4 wherein following step (c) said dyed dye receptive migration image contiguous surface is contacted under dye transfer conditions to a transfer member receptive to said dye to transfer a dye image thereto.

6. An imaging method according to claim 5 wherein said migration image is dyed at least once more and another dye image is transferred to a transfer member receptive to said dye under dye receptive conditions.

7. An imaging method according to claim 4 wherein said migration material is particles with an average particle size between about 0.01 to about 2 microns and said softenable layer is between about ½ to about 16 microns thick.

8. An imaging method according to claim 7 wherein said particles comprise gelatin.

9. An imaging method according to claim 4 wherein the step of developing by decreasing the resistance to migration is accomplished by contacting said softenable layer with a solvent therefor.

10. An imaging method comprising the steps of:

a. providing an imaging member comprising a substantially electrically insulating softenable layer containing dye receptive migration material, said softenable layer capable of having its resistance to migration of said migration material decreased sufficiently to allow migration of said migration material in depth in said softenable layer;

b. applying an electrical imagewise migration force to said migration material;

c. developing the softenable layer by decreasing the resistance of the softenable layer to migration of the migration material through the softenable layer at least sufficient to allow an imagewise migration of migration material to a substrate;

d. removing unmigrated material and softenable material; and e. contacting said migration material with a dye under dye receptive conditions for said migration material only.

11. A method of claim 10 wherein excess dye is placed on said migration material and substrate and further including the step of removing said excess dye to leave an image configuration of dyed dye receptive material on said substrate.

12. An imaging method according to claim 10 wherein the developing and removing steps (c) and (d) are accomplished by contacting said softenable layer with a solvent therefor.

* * * * *